US010300697B2

(12) United States Patent
Muramatsu et al.

(10) Patent No.: US 10,300,697 B2
(45) Date of Patent: May 28, 2019

(54) INKJET RECORDING DEVICE AND INKJET RECORDING METHOD

(71) Applicant: Konica Minolta, Inc., Tokyo (JP)

(72) Inventors: Takashi Muramatsu, Hachioji (JP); Toyoaki Sugaya, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/764,657

(22) PCT Filed: Sep. 28, 2016

(86) PCT No.: PCT/JP2016/078582
§ 371 (c)(1),
(2) Date: Mar. 29, 2018

(87) PCT Pub. No.: WO2017/057436
PCT Pub. Date: Apr. 6, 2017

(65) Prior Publication Data

US 2018/0297360 A1 Oct. 18, 2018

(30) Foreign Application Priority Data

Oct. 1, 2015 (JP) ..... 2015-195604

(51) Int. Cl.
*B41J 2/125* (2006.01)
*B41J 11/00* (2006.01)
(Continued)

(52) U.S. Cl.
CPC ..... *B41J 2/125* (2013.01); *B41J 3/60* (2013.01); *B41J 11/008* (2013.01);
(Continued)

(58) Field of Classification Search
CPC ..... B41J 2/125; B41J 29/393; B41J 11/008; B41J 13/0009
(Continued)

(56) References Cited

U.S. PATENT DOCUMENTS 10,131,137 B2 * 11/2018 Henn ..... B41F 27/005
2012/0127227 A1 * 5/2012 Gocho ..... B26D 5/16 347/16
(Continued)

FOREIGN PATENT DOCUMENTS

CN 103373084 A 10/2013
JP H0260753 A 3/1990
(Continued)

OTHER PUBLICATIONS

International Search Report dated Nov. 8, 2016 for PCT/JP2016/078582 and English translation.
(Continued)

*Primary Examiner* — An H Do
(74) *Attorney, Agent, or Firm* — Lucas & Mercanti, LLP

(57) ABSTRACT

Provided are an inkjet recording device and an inkjet recording method that enable more reliable recording of an image at a desired position of a recording medium. The inkjet recording device is provided with: a recording means that discharges ink onto a recording medium; a conveying means that performs a conveying operation in which the recording medium is placed at a predetermined placement position upon a conveying member and the conveying member is caused to move in a revolving manner; a recording control means that causes the recording means to perform a recording operation in which an image is recorded onto the recording medium, which moves as a result of the conveying operation, by discharging ink thereto in accordance with image data; and a position-correspondence-information
(Continued)

acquiring means that acquires position correspondence information corresponding to the position of the conveying member. The recording control means causes the recording means to start the recording operation when the position of the conveying member corresponding to the position correspondence information acquired by the position-correspondence-information acquiring means matches a recording-operation start position set in advance.

15 Claims, 4 Drawing Sheets

(51) Int. Cl.

| | |
|---|---|
| ***B41J 29/393*** | (2006.01) |
| ***B41J 29/38*** | (2006.01) |
| ***B41J 3/60*** | (2006.01) |
| *B41J 13/22* | (2006.01) |
| *B41J 25/00* | (2006.01) |

(52) U.S. Cl.
CPC ..... *B41J 11/0095* (2013.01); *B41J 29/38* (2013.01); *B41J 29/393* (2013.01); *B41J 13/226* (2013.01); *B41J 2025/008* (2013.01); *B41J 2029/3935* (2013.01); *B41J 2202/21* (2013.01)

(58) Field of Classification Search
USPC ..... 347/5, 16, 101, 104
See application file for complete search history.

(56) References Cited

U.S. PATENT DOCUMENTS

| | | | | |
|---|---|---|---|---|
| 2018/0015745 | A1* | 1/2018 | Juenger | B41J 11/006 |
| 2018/0111395 | A1* | 4/2018 | Sugaya | B65H 7/14 |

FOREIGN PATENT DOCUMENTS

| | | | |
|---|---|---|---|
| JP | 2007069428 | A | 3/2007 |
| JP | 2007283644 | A | 11/2007 |
| JP | 2007301767 | A | 11/2007 |
| JP | 2012016894 | A | 1/2012 |
| JP | 2013010243 | A | 1/2013 |
| JP | 2014050819 | A | 3/2014 |
| JP | 2014168962 | A | 9/2014 |
| JP | 2014213452 | A | 11/2014 |

OTHER PUBLICATIONS

Office Action dated Dec. 4, 2018 from the corresponding Chinese Application No. 201680056084.8 and English translation.
International Preliminary Report on Patentability dated Nov. 8, 2016 from corresponding International Application No. PCT/JP2016/078582 and English translation.

* cited by examiner

INKJET RECORDING DEVICE AND INKJET RECORDING METHOD

CROSS REFERENCE TO RELATED APPLICATION

This Application is a 371 of PCT/JP2016/078582 filed on Sep. 28, 2016, which, in turn, claimed the priority of Japanese Patent Application No. JP 2015-195604 filed on Oct. 1, 2015, both applications are incorporated herein by reference.

TECHNICAL FIELD

The present invention relates to an inkjet recording device and an inkjet recording method.

BACKGROUND ART

There have been inkjet recording devices each of which discharges ink from recording heads on a recording medium conveyed on a conveyance surface of a conveyance means in accordance with image data to record an image on the recording medium. As a conventional technique that enables such an inkjet recording device to record an image at a desired position on the recording medium, there has been a technique of detecting, with a sensor, the front end on a downstream side in the conveyance direction of the recording medium which is conveyed by the conveyance means and adjusting the timing of ink discharge on the basis of the detection timing (for example, Patent Documents 1 to 3).

PRIOR ART DOCUMENTS

Patent Documents

Patent Document 1: Japanese Patent Application Laid Open Publication No. 2007-283644

Patent Document 2: Japanese Patent Application Laid Open Publication No. 2007-69428

Patent Document 3: Japanese Patent Application Laid Open Publication No. 2007-301767

DISCLOSURE OF THE INVENTION

Problems to be Solved by the Invention

However, such a conventional technique may result in an error in the detection position of the front end of the recording medium or improper position detection of the front end, depending on a combination of the method for detecting the front end and the type of the recording medium, thus precluding accurate recording of an image at a desired position on the recording medium.

An object of the present invention is to provide an inkjet recording device and an inkjet recording method for ensuring recording of an image at a desired position on the recording medium.

Means for Solving the Problem

In order to achieve the above object, the invention of the inkjet recording device according to claim 1 includes a recording means which discharges ink onto a recording medium; a conveyance means which performs a conveyance operation of placing the recording medium at a predetermined placement position on a conveyance member and performing a rotary movement of the conveyance member; a recording control means which causes the recording means to perform a recording operation of recording an image by discharging ink onto the recording medium in accordance with image data, the recording medium being moved by the conveyance operation; and a position corresponding information acquisition means which acquires position corresponding information corresponding to a position of the conveyance member, the position being determined by the conveyance operation. In the inkjet recording device, the recording control means causes the recording means to start the recording operation when the position of the conveyance member corresponding to the position corresponding information acquired by the position corresponding information acquisition means matches a recording operation start position which is set in advance.

In the invention according to claim 2, in the inkjet recording device according to claim 1, a plurality of placement positions is set on the conveyance member.

In the invention according to claim 3, the inkjet recording device according to claim 1 further includes a first inverting means which inverts the recording medium placed on the conveyance member and places the inverted recording medium at the placement position. In the inkjet recording device, the recording operation start position is set in advance for each of a case where a target face of the recording medium on which the recording operation is performed by the recording means is one face of the recording medium and a case where the target face of the recording medium is the other face which is opposite to the one face, the recording control means causes the recording means to perform the recording operation on the one face of the recording medium, thereafter causes the first inverting means to invert the recording medium, and causes the recording means to perform the recording operation on the other face of the recording medium, and the recording operation by the recording means on each of the one face and the other face of the recording medium is started when the position of the conveyance member matches the recording operation start position corresponding to the target face of the recording medium on which the recording operation is performed, the position of the conveyance member corresponding to the position corresponding information which is acquired by the position corresponding information acquisition means.

In the invention according to claim 4, the inkjet recording device according to claim 2 further includes a second inverting means which inverts the recording medium placed on the conveyance member and places the inverted recording medium at any one of the placement positions. In the inkjet recording device, the recording operation start position is set in advance for each of a case where a target face of the recording medium on which the recording operation is performed at each of the placement positions is one face of the recording medium and a case where the target face of the recording medium is the other face which is opposite to the one face, the recording control means causes the recording means to perform the recording operation on the one face of the recording medium, thereafter causes the second inverting means to invert the recording medium, and causes the recording means to perform the recording operation on the other face of the recording medium, and the recording operation by the recording means on each of the one face and the other face of the recording medium is started when the position of the conveyance member matches the recording operation start position corresponding to a placement position at which the recording medium is placed and the target face of the recording medium on which the recording operation is performed, the position of the conveyance member corresponding to the position corresponding information which is acquired by the position corresponding information acquisition means.

In the invention according to claim 5, in the inkjet recording device according to any one of claims 1 to 4, the position corresponding information acquisition means acquires the position corresponding information indicating a movement amount from a predetermined reference position of the conveyance member in the conveyance operation.

In the invention according to claim 6, in the inkjet recording device according to claim 5, the position corresponding information acquisition means includes a movement detector which outputs a predetermined detection signal for each predetermined amount of movement of the conveyance member, and the position corresponding information acquisition means acquires the position corresponding information from the output detection signal.

In the invention according to claim 7, in the inkjet recording device according to any one of claims 1 to 6, the position corresponding information acquisition means includes a rotary encoder.

In the invention according to claim 8, in the inkjet recording device according to any one of claims 1 to 7, the conveyance means includes: a position determiner which fixes a position of the recording medium at the placement position by contacting at least one of a front end and a rear end in a direction of the rotary movement of the recording medium; and a holder which holds an end of the recording medium on the conveyance member, at least one of the front end and the rear end of the recording medium being pressed by the position determiner.

In the invention according to claim 9, in the inkjet recording device according to any one of claims 1 to 8, the conveyance means includes a cylindrical drum, the recording medium is placed on an outer periphery of the drum, and the conveyance means performs the conveyance operation by rotating the drum about a cylindrical shaft.

In the invention according to claim 10, the inkjet recording device according to any one of claims 1 to 9 further includes a storing means which stores recording operation start position information indicating the recording operation start position.

In the invention according to claim n, in the inkjet recording device according to claim 10, the recording control means causes the recording means to perform the recording operation to record a predetermined test image on the recording medium in accordance with predetermined test image data, and the inkjet recording device further includes: a first reading means which reads a front end on a downstream side in a direction of the rotary movement of the recording medium on which the test image is recorded and which is conveyed by the conveyance means; a second reading means which reads the test image recorded on the recording medium; and a recording operation start position setting means which sets the recording operation start position based on a recording position of the test image on the recording medium and stores the recording operation start position information in the storing means, the recording position of the test image being specified from data read by the first reading means and the second reading means.

In the invention according to claim 12, in the inkjet recording device according to claim 11, the test image includes a line pattern including a line orthogonal to the direction of the rotary movement.

In the invention according to claim 13, the inkjet recording device according to claim 11 or 12 further includes a conveyance control means which causes the conveyance means to perform the conveyance operation such that a movement speed of the conveyance member during reading by at least one of the first reading means and the second reading means is smaller than a movement speed of the conveyance member during the recording operation by the recording means.

In order to achieve the above object, the invention of the inkjet recording method according to claim 14 is an inkjet recording method by an inkjet recording device that includes: a recording means which discharges ink onto a recording medium; a conveyance means which performs a conveyance operation of placing the recording medium at a predetermined placement position on a conveyance member and performing a rotary movement of the conveyance member; and a position corresponding information acquisition means which acquires position corresponding information corresponding to a position of the conveyance member, the position being determined by the conveyance operation, and the method including: a recording step of causing the recording means to perform a recording operation of recording an image by discharging ink onto the recording medium in accordance with image data, the recording medium being moved by the conveyance operation. In the inkjet recording method, in the recording step, the recording means is caused to start the recording operation when the position of the conveyance member corresponding to the position corresponding information acquired by the position corresponding information acquisition means matches a recording operation start position which is set in advance.

In the invention according to claim 15, the inkjet recording device according to claim 14 further includes: a test image recording step of causing the recording means to perform the recording operation to record a predetermined test image on the recording medium in accordance with predetermined test image data; a reading step of reading the test image and a front end on a downstream side in a direction of the rotary movement of the recording medium when the test image is recorded; and a recording operation start position setting step of setting the recording operation start position based on a recording position of the test image on the recording medium, the recording position being specified from data read in the reading step. In the inkjet recording method, the test image recording step, the reading step and the recording operation start position setting step are performed before the recording step.

Effects of the Invention

The present invention has an advantageous effect of ensuring a proper recording of an image at a desired position of the recording medium.

EMBODIMENTS FOR CARRYING OUT THE INVENTION

An inkjet recording device and an inkjet recording method according to an embodiment of the present invention will now be described with reference to the accompanying drawings.

Figure 1:
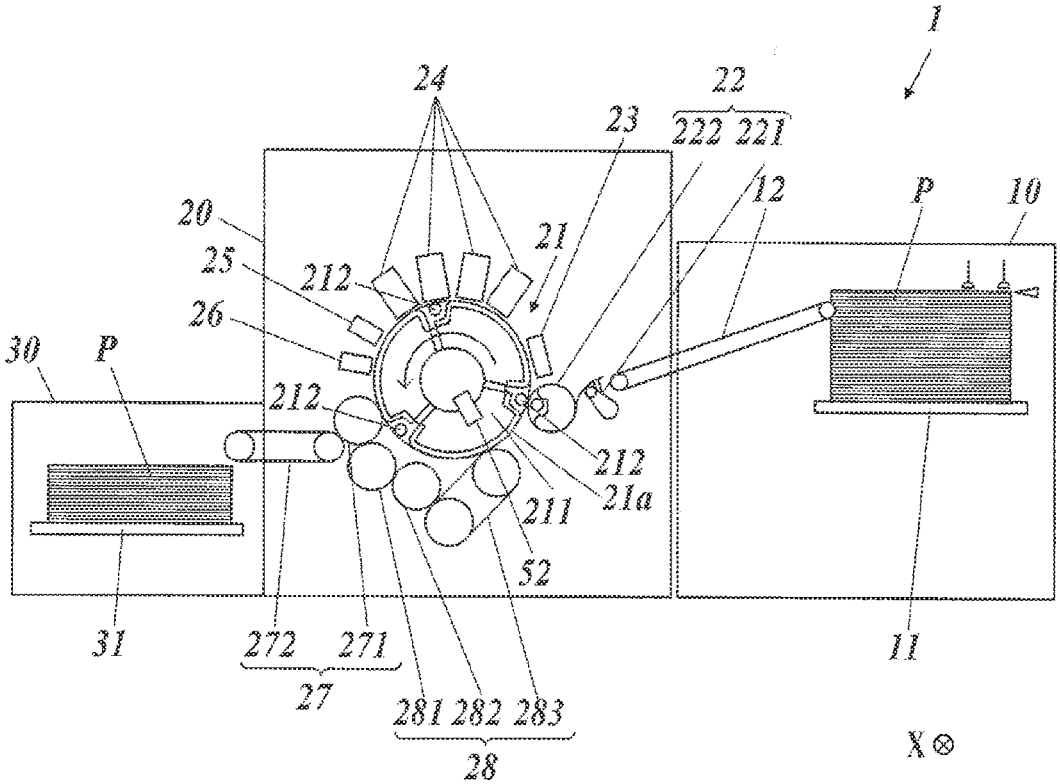
FIG. 1 This is a schematic diagram illustrating a configuration of an inkjet recording device.

FIG. 1 is a schematic diagram illustrating an inkjet recording device 1 according to the embodiment of the present invention.

Figure 3:
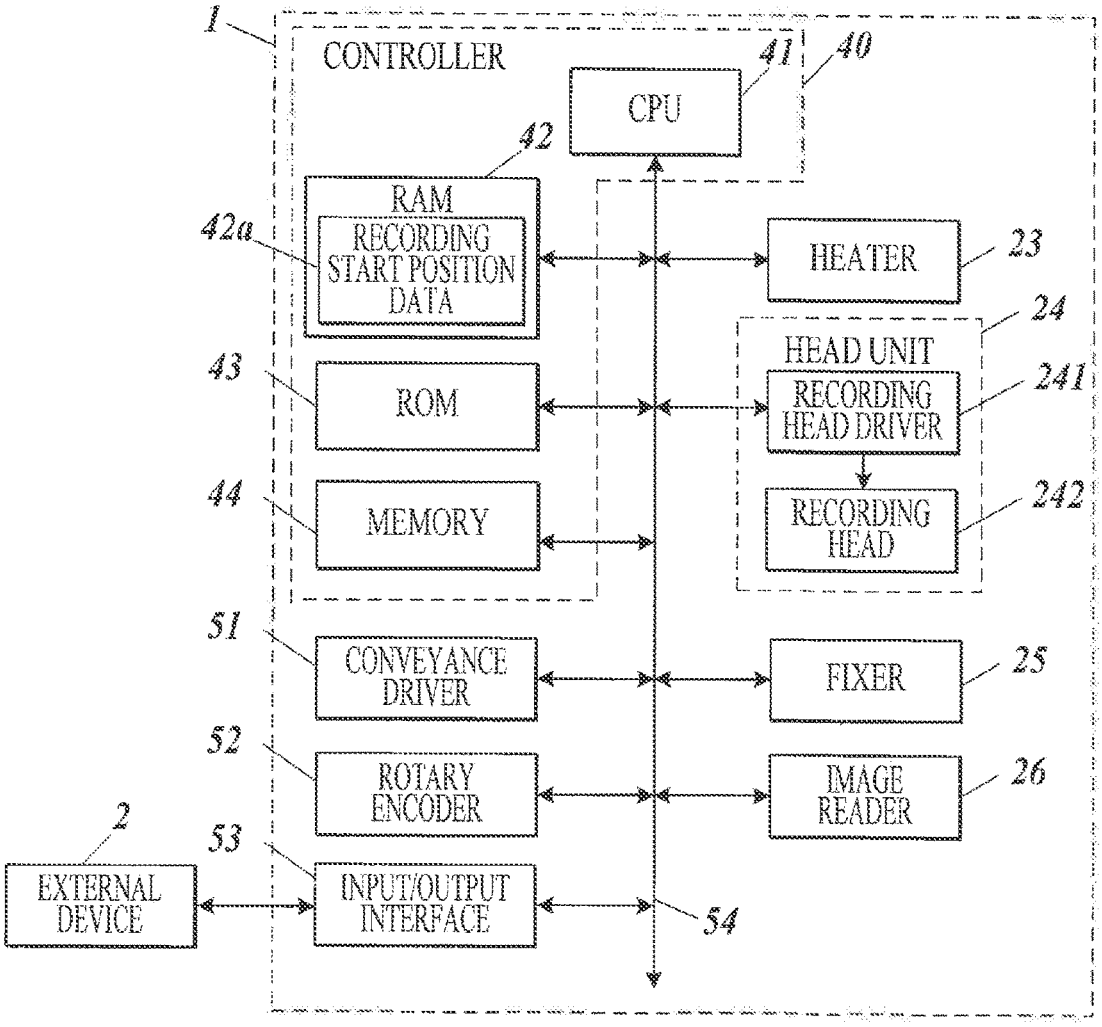
FIG. 3 This is a block diagram illustrating a functional configuration of an inkjet recording device.

The inkjet recording device 1 includes a sheet feeder 10, an image recorder 20, a sheet ejector 30, and a controller 40 (FIG. 3). The inkjet recording device 1 conveys a recording medium P from the sheet feeder 10 to the image recorder 20, forms an image on the recording medium P at the image recorder 20, and conveys the recorded recording medium P to the sheet ejector 30, under the control by the controller 40. The recording medium P may be any one that can fix ink drops applied to a surface. Examples of such media include plain paper, coated paper, cloths, and resin sheets.

The sheet feeder 10 includes a sheet feeding tray 11 which stores the recording medium P and a medium feeder 12 which conveys the recording medium P from the sheet feeding tray 11 to the image recorder 20. The medium feeder 12 is equipped with an endless belt. The inner face of the endless belt is supported by two rollers. The rollers rotate while the recording medium P is disposed on the endless belt to convey the recording medium P from the sheet feeding tray 11 to the image recorder 20.

The image recorder 20 includes a conveyance drum 21 (a conveyance means), a rotary encoder 52 (a movement detector), a passing unit 22, a heater 23, head units 24 (recording means), a fixer 25, an image reader 26 (a first reading means and a second reading means), a delivery section 27, and a inverter 28 (a first inverting means and a second inverting means).

Figure 2:
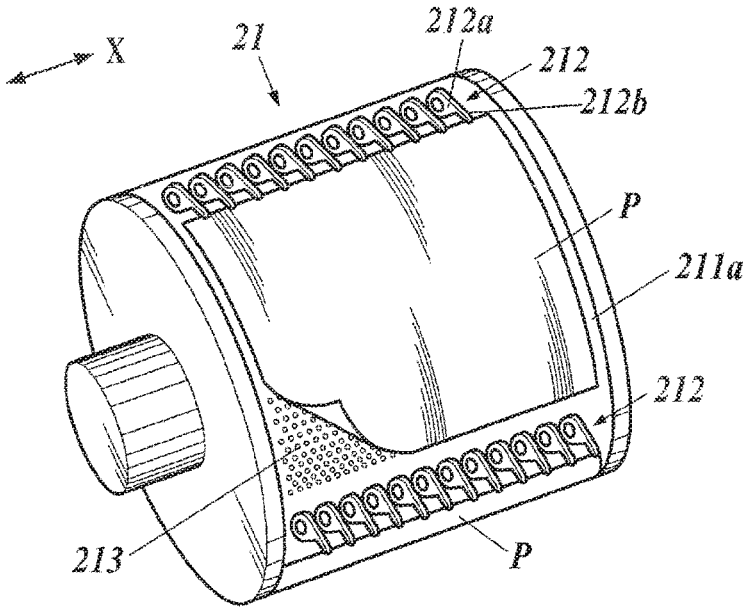
FIG. 2 This is a perspective view of a conveyance drum.

FIG. 2 is a perspective view of the conveyance drum 21.

The conveyance drum 21 holds the recording medium P on a conveyance surface (outer periphery) 211*a* of a cylindrical conveyance member (drum) 211. The conveyance member 211 rotates about the rotational axis (cylindrical shaft) extending in the X direction to perform a rotary movement. This configuration allows the conveyance drum 21 to perform a conveyance operation of conveying the conveyance member 211 and the recording medium P on the conveyance member 211 in the conveyance direction (Y direction). The conveyance drum 21 includes claws 212 and an air sucking portion 213 for holding the recording medium P on the conveyance surface 211*a*.

Each claw 212 includes position determiners 212*a* and holders 212*b*. The position determiners 212*a* come into contact with the front end of the recording medium P in the direction of the rotary movement of the conveyance member 211 to fix the position of the recording medium P at a predetermined placement position. The position determiners 212*a* press the front end of the recording medium P. The holders 212*b* hold the recording medium P on the conveyance member 211. The conveyance drum 21 holds the recording medium P on the conveyance member 211 with the holders 212*b*, while the front end of the recording medium P is in contact with the position determiners 212*a* of the claw 212. This mechanism allows the conveyance drum 21 to convey the recording medium P while keeping the recording medium P on the predetermined placement position of the conveyance member 211. This configuration can reduce an error in the position of the recording medium P to approximately several ten μms. With reference to FIG. 1, the claws 212 are provided at three positions at equal intervals in the Y direction of the conveyance member 211. This configuration allows the conveyance drum 21 to place the recording medium P on three different predetermined placement positions of the conveyance member 211 during conveyance.

The air sucking portion 213 has multiple suction holes and a suction generator, for example, a pneumatic pump or a fan (not shown). The suction holes are formed on the conveyance member 211 of the conveyance drum 21 to hold the recording medium P, which is fixed by the claw 212, along the conveyance member 211. The suction generator generates suction force that sucks in air into the conveyance drum 21 through the suction holes. In other words, the air sucking portion 213 attracts the recording medium P by the suction force of the air through the suction holes to hold the recording medium P along the conveyance surface 211*a* of the conveyance drum 21.

The conveyance drum 21 is connected to a conveyance drum motor (not shown) that rotates the conveyance drum 21, and turns by an angle in proportion to the rotation of the conveyance drum motor.

As shown in FIG. 2, the recording medium P is partially detached from the conveyance surface 211*a* of the conveyance drum 21 to illustrate the suction holes. During conveyance of the recording medium P on the conveyance drum 21, the entire recording medium P is held on the conveyance surface 211*a* of the conveyance drum 21.

The rotary encoder 52 is mounted to the conveyance drum 21 and outputs a pulsed signal (detection signal) to the controller 40 every time the conveyance drum 21 rotates by a predetermined angle. The rotary encoder 52 may have any configuration. For example, it may include, a code wheel, a light emitter, and a light receiver. The code wheel is provided with slits arrayed at predetermined circumferential positions and rotates together with the conveyance drum 21. The light emitter emits light to the slits on the code wheel. The light receiver detects light passing through the slits after emission from the light emitter. The rotary encoder 52 outputs a pulsed signal to the controller 40 in response to the detection of the light by the light receiver. The rotary encoder 52 outputs a reference pulsed signal to the controller 40 each time the conveyance drum 21 rotates once. The controller 40 counts the number of pulsed signals received after the receipt of the reference pulsed signal and sets the position of the conveyance member 211 of the conveyance drum 21 based on the count. The count according to this embodiment represents position corresponding information corresponding to the conveyance operation of the conveyance member 211.

The passing unit 22 delivers the recording medium P conveyed from the medium feeder 12 of the sheet feeder 10 to the conveyance drum 21. The passing unit 22 is disposed between the medium feeder 12 of the sheet feeder 10 and the conveyance drum 21. The passing unit 22 holds and take up one end of the recording medium P conveyed on the medium feeder 12 at a swing arm 221 and delivers the recording medium P to the conveyance drum 21 via the reception drum 222.

The heater 23 is disposed between the reception drum 222 and the head units 24. The heater 23 heats the recording medium P on the conveyance drum 21 to a temperature within a predetermined range. The heater 23 includes, for example, an infrared heater. The infrared heater is energized in accordance with control signals sent from a CPU 41 (FIG. 3) to generate heat.

The head units 24 discharge ink onto the recording medium P on the conveyance drum 21 in accordance with image data to record an image. The head units 24 are disposed such that ink discharging faces face the conveyance surface 211*a* of the conveyance drum 21 at a predetermined gap. The inkjet recording device 1 according to this embodiment includes the four head units 24 corresponding to four colors of C (cyan), M (magenta), Y (yellow), and K (black). These head units 24 are disposed at predetermined intervals in the order of Y, M, C, and K from the upstream side in the conveyance direction of the recording medium P.

Recording operation starts at the head unit 24 of the color Y disposed at the most upstream position in the conveyance direction when the conveyance member 211 moves to a preset recording operation start position corresponding to the placement position of the recording medium P. Recording operation starts at the head units 24 of the colors M, C, and K when the conveyance member 211 moves by distances corresponding to the relative distances from the head unit 24 of the color Y after the start of recording at the head unit 24 of the color Y.

Each head unit 24 includes several (for example, four) recording heads 242 (see FIG. 3) and a recording head driver 241 for driving the recording heads 242 (see FIG. 3). Each recording head 242 includes multiple recording elements disposed in a direction crossing the conveyance direction of the recording medium P (the direction orthogonal to the conveyance direction, i.e., the X direction in this embodiment).

The recording head driver 241 includes a driving circuit and a drive controlling circuit. The driving circuit feeds a voltage signal with a driving waveform to each recording head 242 in accordance with image data. The drive controlling circuit feeds image data to the driving circuit at an appropriate timing.

Each recording element in the recording head 242 includes a pressure chamber for storing ink, a piezoelectric element disposed on a wall of the pressure chamber, and a nozzle. The driving circuit of the recording head driver 241 applies a voltage signal with a driving waveform to the piezoelectric elements to deform the piezoelectric element. The deformation varies the pressure in the pressure chamber according to the voltage signal to discharge the ink through the nozzle, which is in communication with the pressure chamber.

The recording elements in each head unit 24 are disposed to cover the X direction of the region on which an image is recorded in the recording medium P on the conveyance drum 21. The head units 24 are fixed relative to the conveyance drum 21 during recording of an image. In other words, the inkjet recording device 1 is a single-pass inkjet recording device equipped with a line head.

The ink discharged from the nozzle of each recording element undergoes a phase transition, i.e., gelation or solation in response to temperature, or is cured by irradiation with energy rays, such as ultraviolet rays.

The ink used in this embodiment is in a gel state at a normal temperature and solates when heated. The head units 24 are each provided with an ink heater (not shown) for heating the ink stored in the head unit 24. The ink heater heats the ink to a sol state under the control by the CPU 41. The recording heads 242 discharge the ink in the sol state after heating. The ink is discharged in the sol state onto the recording medium P in the form of ink drops. The ink drops are naturally cooled to gelate and solidify on the recording medium P promptly.

The fixer 25 includes a light emitter extending across the width (X direction) of the conveyance drum 21. The fixer 25 irradiates the recording medium P on the conveyance drum 21 with energy rays, such as ultraviolet rays, from the light emitter to cure the ink discharged on the recording medium P. The light emitter of the fixer 25 is disposed downstream of the head units 24 and upstream of a reception drum 271 of the delivery section 27 in the conveyance direction so as to face the conveyance surface 211*a*.

The image reader 26 is disposed downstream of the ink fixing position of the fixer 25 and upstream of the reception drum 271 in the conveyance direction such that the conveyance surface 211*a* (and the front face of the recording medium P on the conveyance surface 211*a*) are readable. The image reader 26 detects the front end of the recording medium P on the conveyance drum 21 and reads an image formed on the recording medium P within a predetermined reading range to output imaging data of the read image.

The image reader 26 according to this embodiment includes a light source and a line sensor. The light source illuminates the recording medium P on the conveyance drum 21 with light. The line sensor has imaging elements arrayed in the X direction. The imaging elements detect the intensity of the light reflected from the recording medium P. The line sensor can acquire imaging data of an image for each of wavelength components, for example, three wavelength components of R (red), G (green), and B (blue). The image reader 26 may have any other configuration. For example, it may include an area sensor, instead of the line sensor.

The delivery section 27 includes an endless belt 272 and a cylindrical reception drum 271. The inner face of the endless belt 272 is supported by two rollers. The reception drum 271 delivers the recording medium P from the conveyance drum 21 to the endless belt 272. The endless belt 272 conveys the recording medium P to the sheet ejector 30.

The inverter 28 inverts the recording medium P under the control by the CPU 41. More specifically, the inverter 28 receives the recording medium P from the reception drum 271, inverts the recording medium P, and then delivers the inverted recording medium P to the conveyance drum 21. The delivered recording medium P is placed on one of the three placement positions of the conveyance member 211. The inverter 28 includes a first drum 281, a second drum 282, and an endless belt 283.

With reference to FIG. 1, the inverter 28 delivers the recording medium P from the reception drum 271 rotating clockwise to the first drum 281 rotating counterclockwise, to the second drum 282 rotating clockwise, and to the endless belt 283 rotating counterclockwise. When the rear end of the recording medium P reaches the vicinity of the nip between the second drum 282 and the endless belt 283, the endless belt 283 rotate backward or clockwise, as shown in FIG. 1. This configuration places the recording medium P on one of the three placement positions of the conveyance member 211 of the conveyance drum 21 upstream of the reception drum 222 in the conveyance direction. The recording medium P placed on the conveyance member 211 by the inverter 28 is held again on the conveyance drum 21 such that the face with the image is in contact with the conveyance surface 211*a*.

The inverter 28 may have any other configuration that allows, for example, the recording medium P to be inverted and delivered to the conveyance drum 21.

The sheet ejector 30 includes a platy sheet ejecting tray 31. The sheet ejecting tray 31 receives the recording medium P from the delivery section 27 of the image recorder 20.

FIG. 3 is a block diagram illustrating a functional configuration of the inkjet recording device 1.

The inkjet recording device 1 further includes the controller 40, a conveyance driver 51, an input/output interface 53, and a bus 54, besides the heater 23, the head units 24, the fixer 25, the image reader 26, and the rotary encoder 52. The controller 40 includes a central processing unit (CPU) 41 (functioning as a recording control means, a recording operation start position setting means, and a conveyance control means), a random access memory (RAM) 42 (a storing means), a read only memory (ROM) 43, and a memory 44.

The CPU 41 reads various control programs and setting data from the ROM 43, stores these programs and the setting data in the RAM 42, and executes these programs to perform various operations. The CPU 41 controls the entire operation of the inkjet recording device 1. For example, the CPU 41 operates individual components of the image recorder 20 based on the image data stored in the memory 44 to record an image on the recording medium P. The CPU 41 sets recording operation start positions for recording on the front face and on the back face of the sheet for each of the three placement positions based on the imaging data of a test image recorded on the recording medium P and stores these recording operation start positions in the RAM 42. The CPU 41 acquires the position of the conveyance drum 21 based on the number of pulsed signals output from the rotary encoder 52. The rotary encoder 52 and the CPU 41 according to this embodiment together constitutes a position corresponding information acquisition means.

The RAM 42 provides the CPU 41 with a working memory space and stores temporary data there. The RAM 42 contains recording operation start position data 42*a* (recording operation start position information) indicating a recording operation start position of the head unit 24 of the color Y. The RAM 42 may include a non-volatile memory.

The recording operation start position data 42*a* indicates the position of the conveyance member 211 (the recording operation start position) with the count of the number of pulsed signals output from the rotary encoder 52.

The recording operation start position data 42*a* contains recording operation start position data for recording on the first or front face of the recording medium P and recording operation start position data for recording on the second or back face of the recording medium P for each of the three placement positions of the conveyance drum 21. In other words, the recording operation start position data 42*a* contains two pieces of the recording operation start position data for each of the three placement positions, i.e., six pieces of the recording operation start position data in total. The term "front face" according to this embodiment refers to a face on which an image is recorded first of the two faces of the recording medium P.

The ROM 43 contains the various control programs to be executed by the CPU 41 and setting data. The setting data includes test image data. The test image data is data of a test image used in the process of setting the recording operation start position described below. The ROM 43 also contains initial recording operation start positions prior to generation of the recording operation start position data 42*a* or tentative recording operation start positions described below. The ROM 43 may be replaced with a non-volatile memory, such as electrically erasable programmable read only memory (EEPROM) or a flash memory.

The memory 44 contains a print job (image recording instruction) entered from an external device 2 via the input/output interface 53, image data for the print job, and imaging data read by the image reader 26. The memory 44 is, for example, a hard disk drive (HDD) and may be used together with a dynamic random access memory (DRAM).

The conveyance driver 51 feeds a driving signal to the conveyance drum motor that drives the conveyance drum 21 based on a control signal fed by the CPU 41 to rotate the conveyance drum 21 at a predetermined rate and timing. The conveyance driver 51 feeds drive signals to motors that drive the medium feeder 12, the passing unit 22, and the delivery section 27 based on control signals fed by the CPU 41 to feed the recording medium P to the conveyance drum 21 and discharge the recording medium P from the conveyance drum 21. The conveyance driver 51 operates the first drum 281, the second drum 282, and the endless belt 283 of the inverter 28 based on a control signal fed by the CPU 41 and causes the inverter 28 to invert the recording medium P.

The input/output interface 53 mediates between the external device 2 and the controller 40 to convey and receive data. The input/output interface 53 is, for example, one of serial interfaces or parallel interfaces or any combination thereof.

The bus 54 is a path for sending and receiving signals between the controller 40 and other units.

The external device 2 is, for example, a personal computer to send print jobs and image data to the controller 40 via the input/output interface 53.

The image recording operations of the inkjet recording device 1 will now be explained.

As described above, the inkjet recording device 1 has a single recording medium P placed on any one of the three placement positions of the conveyance member 211. Up to three recording media P are placed and conveyed on the three placement positions of the conveyance member 211. When the recording medium P is delivered from the passing unit 22 to the conveyance member 211 to be placed on any placement position of the conveyance member 211, placement position data indicating the placement position is output from the conveyance driver 51 to the controller 40. Indication of a particular placement position on which the recording medium P is placed in the placement position data allows image recording to start when the conveyance member 211 moves to a preset recording operation start position corresponding to the particular placement position. This enables image recording at a desired position of the recording medium P.

In detail, during conveyance of the recording medium P on one of the three placement positions of the conveyance member 211 of the inkjet recording device 1, a recording operation start position corresponding to the placement position of the recording medium P is referenced from the recording operation start position data 42*a* stored in the RAM 42. When the conveyance member 211 moves to the recording operation start position, i.e., when the count of the number of pulsed signals output from the rotary encoder 52 matches the number indicated by the recording operation start position data, image recording starts at the head unit 24 at the most upstream position in the conveyance direction or the head unit 24 of the color Y.

The inkjet recording device 1 may be instructed by a print job to record images on the front and back faces of the recording medium P. In this case, an image is recorded on the front face of the recording medium P, the recording medium P is inverted by the inverter 28, and then an image is recorded on the back face of the recording medium P. The recording operation start position for the front face of the two recording operation start positions for the placement position of the recording medium P is referenced for recording on the front face of the recording medium P. When the conveyance member 211 moves to the recording operation start position, the recording is started. The recording operation start position for the back face of the two recording operation start positions for the placement position of the recording medium P is referenced for recording on the back face of the recording medium P. When the conveyance member 211 moves to the recording operation start position, recording starts.

The inkjet recording device 1 may be instructed by a print job to record an image on one face of the recording medium P. In this case, the recording operation start position for the front face is used.

The recording operation start positions are set during production or before shipment of the inkjet recording device 1 or at the time of replacement of the head units 24. The recording operation start positions are stored in the RAM 42 as the recording operation start position data 42*a*. The recording operation start positions are set in the process of setting the recording operation start position of the inkjet recording device 1. The process of setting the recording operation start position will now be explained.

In the process of setting the recording operation start position, the recording medium P is placed on any one of the three placement positions, and the head units 24 records a predetermined test image on the front face of the recording medium P. The test image is recorded at the tentative recording operation start position. The tentative recording operation start position is determined in accordance with a design value for each placement position and stored in the ROM 43.

The test image includes a line pattern including lines extending in the X direction. To facilitate the determination whether image recording starts at a desired position of the recording medium P, the test image preferably includes an X line indicating the edge on the downstream side in the conveyance direction of an image-recordable rectangular area in the recording medium P.

After the test image is recorded on the front face of the recording medium P, the recording medium P on the conveyance drum 21 is conveyed to the image reader 26. The image reader 26 detects the front end on the downstream side in the conveyance direction of the recording medium P and reads the test image. The recording operation start position is determined as follows: Based on the results of the reading of the image reader 26 (imaging data), the distance between the front end of the recording medium P and the predetermined X line of the test image is calculated. In the case where the test image is recorded at an appropriate position of the recording medium P, the distance between the predetermined X line and the front end of the recording medium P is then calculated. A difference between the two distances is calculated. The tentative recording operation start position used to record the test image is corrected based on the calculated difference. The corrected recording operation start position is stored in the RAM 42 as the recording operation start position data 42*a*. The recording operation start position is thereby determined.

The inverter 28 inverts the recording medium P with the test image recorded on the front face and places the recording medium P on the identical placement position used in the recording of the test image on the front face. Similar to the front face, the test image is recorded on the back face of the recording medium P. The tentative recording operation start position is corrected based on the results of the reading of the test image. The corrected recording operation start position is stored in the RAM 42 as the recording operation start position data 42*a* to determine a recording operation start position.

The process of setting the recording operation start positions for the front face and the back face is performed for the two remaining placement positions. In other words, the front-face and back face recording operation start positions are set for each of the three placement positions.

The control of the process of setting the recording operation start position by the CPU 41 will now be described.

Figure 4:
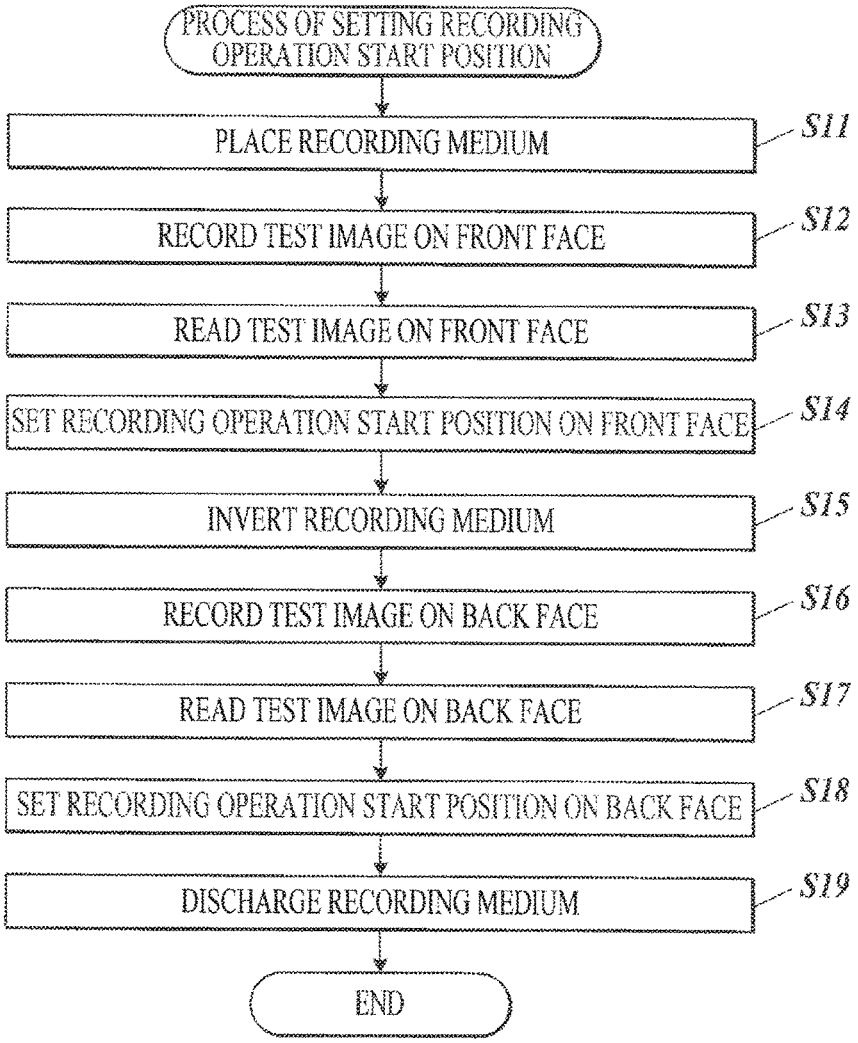
FIG. 4 This is a flowchart illustrating the control of the process of setting a recording operation start position.

FIG. 4 is a flowchart illustrating the control of the process of setting the recording operation start position.

Before the start of the process of setting the recording operation start position, the CPU 41 causes the conveyance driver 51 to output a drive signal to the conveyance drum motor of the conveyance drum 21 to start the rotation of the conveyance drum 21. The CPU 41 then starts counting the number of pulsed signals output from the rotary encoder 52 to the controller 40. The count is reset every time the controller 40 receives a reference pulsed signal from the rotary encoder 52.

Once the process of setting the recording operation start position is started, the CPU 41 causes the conveyance driver 51 to output a drive signal to a motor that drives the medium feeder 12 and the passing unit 22. In response to the drive signal, the recording medium P is delivered from the sheet feeding tray, placed on any one of the placement positions of the conveyance member 211 of the conveyance drum 21, and held with the claws 212 of the conveyance drum 21 (Step S11).

With reference to the tentative recording operation start position in the placement position of the recording medium P, the CPU 41 causes the head units 24 to start recording operations when the conveyance member 211 moves to the recording operation start position, thereby recording the test image on the front face of the recording medium P (Step S12: test image recording step). More specifically, the CPU 41 causes the head units 24 to start recording operations if the count of the number of pulsed signals output from the rotary encoder 52 matches the number indicated by the tentative recording operation start position. The CPU 41 causes the drive controlling circuit of the recording head driver 241 to feed the test image data stored in the ROM 43 to the driving circuit at an appropriate timing in accordance with the rotation of the conveyance drum 21 to perform the recording operations.

The CPU 41 causes the image reader 26 to detect the front end of the recording medium P and read the test image formed on the recording medium P during conveyance of the recording medium P on the conveyance drum 21, to acquire imaging data, and to store the acquired data in the memory 44 (Step S13: reading step). At Step S13, the CPU 41 causes the conveyance driver 51 to drive the conveyance drum motor of the conveyance drum 21 such that the movement speed of the conveyance drum 21 at Step S13 is lower than that of the conveyance drum 21 at Step S12.

The CPU 41 sets a recording operation start position for the front face of the recording medium P based on the results of the reading of the image reader 26 (Step S14: recording operation start position setting step) as follows: The CPU 41 calculates a distance between the front end of the recording medium P and the predetermined line of the test image based on the results of the reading of the image reader 26. In the case where the test image is recorded at an appropriate position of the recording medium P, the CPU 41 then calculates the distance between the predetermined line and the front end of the recording medium P. The CPU 41 further calculates a difference between the two calculated distances. The CPU 41 corrects the tentative recording operation start position used in Step S12 based on the calculated difference and stores the corrected recording operation start position in the RAM 42 as the recording operation start position data 42*a*.

The CPU 41 causes the conveyance driver 51 to output a control signal to the inverter 28. In response to the control signal, the inverter 28 inverts the recording medium P and places the inverted recording medium P on the identical placement position on the conveyance member 211. The CPU 41 causes the claws 212 of the conveyance drum 21 to hold the recording medium P (Step S15).

The CPU 41 causes the head units 24 to record the test image on the back face of the recording medium P (Step S16: test image recording step). The CPU 41 causes the image reader 26 to detect the front end of the recording medium P and read the test image (Step S17: reading step). Based on the results of the reading, the CPU 41 sets a recording operation start position for the back face (Step S18: recording operation start position setting step). Steps S16 to S18 are not described because these steps are identical to Steps S12 to S14, except that the process is performed on the back face of the recording medium P.

The CPU 41 causes the conveyance driver 51 to output a drive signal to the motor that drives the delivery section 27. In response to the drive signal, the recording medium P is discharged to the sheet ejector 30 (Step S19).

At the end of Step S19, the CPU 41 terminates the process of setting the recording operation start position.

The process of setting the recording operation start position is performed for each of the three placement positions of the conveyance member 211.

The control of the image recording process at the inkjet recording device 1 by the CPU 41 will now be explained.

Figure 5:
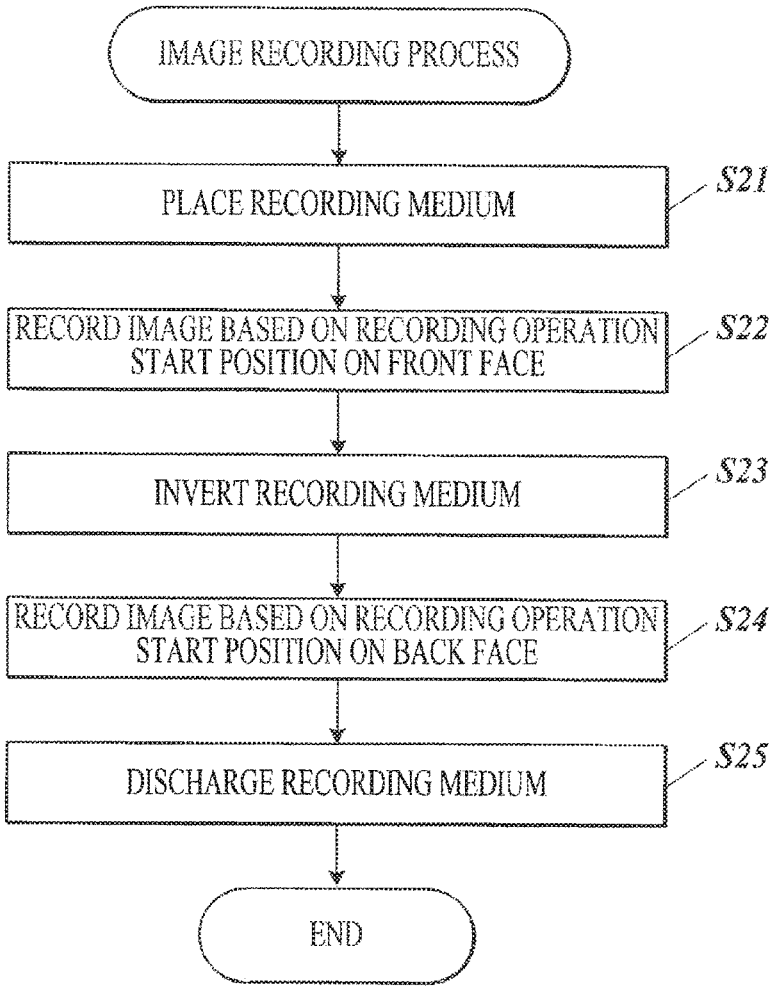
FIG. 5 This is a flowchart illustrating the control of an image recording process.

FIG. 5 is a flowchart illustrating the control of the image recording process.

The image recording process is performed when a print job and image data are entered to the controller 40, for example, from the external device 2 via the input/output interface 53. Prior to the start of the image recording process, the CPU 41 causes the conveyance driver 51 to output a drive signal to the conveyance drum motor of the conveyance drum 21 to start the rotation of the conveyance drum 21. The CPU 41 then starts counting the number of pulsed signals output from the rotary encoder 52 to the controller 40. The count is reset every time a reference pulsed signal is output from the rotary encoder 52 to the controller 40.

At the start of the image recording process, the CPU 41 causes the conveyance driver 51 to output a drive signal to the motor that drives the medium feeder 12 and the passing unit 22. In response to the drive signal, the recording medium P is delivered from the sheet feeding tray 11, placed on any one of the placement positions of the conveyance member 211 of the conveyance drum 21, and held with the claws 212 of the conveyance drum 21 (Step S21).

The CPU 41 causes the head units 24 to start recording at the recording operation start position for recording on the front face of the recording medium P in the placement position of the recording medium P to record an image on the recording medium P (Step S22: recording step). In other words, the CPU 41 acquires the recording operation start position for recording on the front face of the two recording operation start positions for the placement position of the recording medium P, with reference to the recording operation start position data 42*a* stored in the RAM 42. When the conveyance member 211 moves to the acquired recording operation start position, the CPU 41 causes the head units 24 to start recording operations to record the image on the front face of the recording medium P. In detail, if the count of the number of pulsed signals output from the rotary encoder 52 matches the number indicated by the acquired recording operation start position, the CPU 41 causes the head units 24 to start recording operations. The CPU 41 feeds the image data stored in the memory 44 from the drive controlling circuit of the recording head driver 241 to the driving circuit at an appropriate timing in accordance with the rotation of the conveyance drum 21 to perform the recording operations.

The CPU 41 causes the conveyance driver 51 to output a control signal to the inverter 28. In response to the control signal, the inverter 28 inverts the recording medium P and places the inverted recording medium on any one of the three placement positions of the conveyance member 211. The claws 212 of the conveyance drum 21 holds the recording medium (Step S23).

The CPU 41 causes the head units 24 to start recording at the recording operation start position for recording on the back face of the recording medium P in the placement position of the recording medium P to record an image on the recording medium P (Step S24: recording step). In other words, the CPU 41 acquires the recording operation start position for recording on the back face of the two recording operation start positions for the placement position of the recording medium P with reference to the recording operation start position data 42*a* stored in the RAM 42. When the conveyance member 211 moves to the acquired recording operation start position, the CPU 41 causes the head units 24 to start recording operations to record the image on the back face of the recording medium P. In detail, if the count of the number of pulsed signals output from the rotary encoder 52 matches the number indicated by the acquired recording operation start position, the CPU 41 causes the head units 24 to start recording operations. The CPU 41 feeds the image data stored in the memory 44 from the drive controlling circuit of the recording head driver 241 to the driving circuit at an appropriate timing in accordance with the rotation of the conveyance drum 21 to perform the recording operations.

At the end of recording on the back face of the recording medium P, the CPU 41 causes the conveyance driver 51 to output a drive signal to the motor that drives the delivery section 27. In response to the drive signal, the sheet ejector 30 discharges the recording medium P (Step S25).

At the end of Step S25, the CPU 41 terminates the image recording process.

If an image is recorded on only the front face of the recording medium P, Steps S23 and S24 are omitted from the image recording process.

As described above, the inkjet recording device 1 according to the present embodiment includes: the head units 24 discharging ink onto the recording medium P, the conveyance drum 21 performing the conveyance operation, and the CPU 41. The conveyance operation involves the placement of the recording medium P on a predetermined placement position of the conveyance member 211 and a rotary movement of the conveyance member 211. The CPU 41 includes the recording control means, the position corresponding information acquisition means, and the recording control means. The recording control means causes the head units 24 to perform the recording operation that involves discharge of ink on the recording medium P in accordance with image data during the conveyance operation of the recording medium P to record an image. The position corresponding information acquisition means receives the count of the number of pulsed signals (position corresponding information) from the rotary encoder 52 which corresponds to a position resulting from the conveyance operation of the conveyance member 211. The recording control means causes the head units 24 to start the recording operation if the position of the conveyance member 211 corresponding to the received count matches the preset recording operation start position. This configuration allows image recording on the transported recording medium P to start stably at an appropriate timing without detection of the position of the recording medium P every time, resulting in secure image recording at a desired position of the recording medium P. This configuration also eliminates the necessity for detection of the position of the recording medium P, thereby achieving a compact inkjet recording device 1 at a low cost. The position corresponding information, which corresponds to the position of the conveyance member 211 (the count in this embodiment), can determine the timing of starting the recording operation. This facilitates image recording at a desired position of the recording medium P based on the position corresponding information acquired readily by, for example, counting the number of pulsed signals.

The conveyance member 211 has a plurality of placement positions. This facilitates image recording at a desired position of the recording medium P, regardless of the placement position of the multiple placement positions on which the recording medium P is placed.

The inkjet recording device 1 includes an inverter 28. The inverter 28 inverts the recording medium P on the conveyance member 211 and places the inverted recording medium P at a placement position. The recording operation start position is predetermined for each of a case where the target face of the recording medium P on which the recording operation is performed by the head units 24 is the front face of the recording medium P and a case where the target face is the back face of the recording medium P. The CPU 41 causes the head units 24 to perform the recording operation on the front face of the recording medium P, causes the inverter 28 to invert the recording medium P, and causes the head units 24 to perform the recording operation on the back face of the recording medium P (recording control means). The recording operation on the front or back face of the recording medium P by the head units 24 starts if the recording operation start position corresponding to the target face of the recording medium P on which the recording operation is performed matches the position of the conveyance member 211 corresponding to the count of the number of pulsed signals. If image recording is performed on the back face of the recording medium P after the front face, the recording medium P at the start of image recording on the back face may be more contracted or expanded than that at the start of image recording on the front face, due to application of heat to the recording medium P during image recording on the front face or saturation of ink into the recording medium P. Meanwhile, the inkjet recording device according to this embodiment, where recording operation start positions for the front face and the back face are set separately, as described above, image recording on the back face can be started at an appropriate timing, in consideration of the contraction or expansion of the recording medium P.

The inkjet recording device 1 includes an inverter 28. The inverter 28 inverts the recording medium P on the conveyance member 211 and places the inverted recording medium P at any one of the plurality of placement positions. The recording operation start position is set in advance for each of a case where a target face of the recording medium P on which the recording operation is performed at each of the placement positions is one face of the recording medium P and a case where the target face of the recording medium P is the other face which is opposite to the one face. The CPU 41 causes the head units 24 to perform the recording operation on the front face of the recording medium P, causes the inverter 28 to invert the recording medium P, and causes the head units 24 to perform the recording operation on the back face of the recording medium P (recording control means). The recording operation on the front or back face of the recording medium P by the head units 24 starts if the recording operation start position corresponding to a placement position at which the recording medium P is placed and the target face of the recording medium P on which the recording operation is performed matches the position of the conveyance member 211 corresponding to the count of the number of pulsed signals. This configuration allows image recording to start at an appropriate timing based on the recording operation start position determined separately wherever the recording medium P is placed on any one of the multiple placement positions or wherever the recording operation is performed on the front or back face of the recording medium P.

The rotary encoder 52 and the CPU 41, which together constitutes the position corresponding information acquisition means, acquires the count of the number of pulsed signals, which indicates the movement amount of the conveyance member 211 from the predetermined reference position during the conveyance operation. This configuration allows the position corresponding information, which indicates the movement amount of the conveyance member 211, to be acquired readily and facilitates image recording at a desired position of the recording medium P based on the position corresponding information.

The rotary encoder 52, which constitutes the position corresponding information acquisition means together with the CPU 41, outputs a pulsed signal every time the conveyance member 211 rotates by a predetermined angle. The CPU 41 receives the count of the number of output pulsed signals. This configuration allows the position corresponding information (count) to be received readily by counting the number of pulsed signals.

The position corresponding information acquisition means, which includes the rotary encoder 52, facilitates the receipt of the position corresponding information (count) by counting the number of pulsed signals from the rotary encoder 52.

The conveyance drum 21 includes the position determiners 212*a* of the claws 212 and the holders 212*b* of the claws 212. The position determiners 212*a* come into contact with the front end of the recording medium P in the direction of the rotation of the conveyance member 211 to fix the recording medium P at a placement position. The position determiners 212*a* press the front end of the recording medium P. The holders 212*b* hold the recording medium P on the conveyance member 211. This configuration facilitates the placement of the recording medium P on a predetermined placement position of the conveyance member 211.

The conveyance drum 21 includes the cylindrical conveyance member 211 (drum). The recording medium P is placed on the outer periphery of the conveyance member 211. The conveyance drum 21 performs the conveyance operation that involves rotation of the conveyance member 211 about the cylindrical shaft. This configuration allows the conveyance drum 21 to perform the conveyance operation without deformation of the conveyance member 211 and hold the recording medium P at a placement position, regardless of the position of the conveyance member 211. This increases the degree of freedom of the position for placing the recording medium P on the conveyance member 211 and discharging the recording medium P from the conveyance member 211.

The inkjet recording device 1 includes the RAM 42 storing the recording operation start position data 42*a*, which indicates recording operation start positions. This configuration allows the CPU 41 or the recording control means to start the recording operation at an appropriate timing with reference to the recording operation start position data 42*a*.

The CPU 41 or recording control means causes the head units 24 to perform the recording operation in accordance with test image data to record the predetermined test image on the recording medium P. The inkjet recording device 1 includes the image reader 26. After the recording of the test image, the image reader 26 detects the front end on the downstream side in the direction of the rotary movement of the recording medium P on the conveyance drum 21 and reads the test image. The CPU 41 or recording operation start position setting means sets the recording operation start position based on the recording position of the test image on the recording medium P indicated by the data read by the image reader 26 and stores the recording operation start position in the RAM 42 as the recording operation start position data 42*a*. This configuration allows the inkjet recording device 1 to determine the recording operation start position.

The test image includes a line pattern including lines orthogonal to the direction of the rotary movement of the conveyance drum 21. This facilitates the acquisition of a distance between the front end of the recording medium P and the test image readily and accurately. This allows a recording operation start position to be set more readily and accurately based on the recording position of the test image on the recording medium P.

The CPU 41 or the conveyance control means causes the conveyance drum 21 to perform the conveyance operation such that the movement speed of the conveyance member 211 during reading by the image reader 26 is lower than that during the recording operation by the head units 24. This enhances the reading resolution of the image reader 26 to allow the positions of the front end of the recording medium P and the test image to be acquired at a high accuracy. This facilitates more appropriate determination of a recording operation start position, resulting in accurate image recording at a desired position on the recording medium P.

The inkjet recording method according to this embodiment is an inkjet recording method using the inkjet recording device 1. The inkjet recording device 1 includes the head units 24, the conveyance drum 21, and the CPU 41 or the position acquisition means. The head units 24 discharge ink onto the recording medium P. The conveyance drum 21 performs the conveyance operation that involves rotation of the conveyance member 211 while the recording medium P is placed on the predetermined placement position of the conveyance member 211. The CPU 41 or the position acquisition means sets the position of the conveyance member 211 based on pulsed signals from the rotary encoder 52. The inkjet recording method includes a recording step. The recording step involves causing the head units 24 to perform a recording operation of recording an image by discharging ink onto the recording medium P in accordance with image data, the recording medium P being moved by the conveyance operation. In the recording step, the CPU 41 causes the head units 24 to start the recording operation if the position of the conveyance member 211 received by the CPU 41 matches the preset recording operation start position. This configuration allows image recording on the transported recording medium P to start stably at an appropriate timing every time, resulting in secure image recording at a desired position on the recording medium P.

The inkjet recording method according to this embodiment includes a test image recording step of causing the head units 24 to perform the recording operation to record a predetermined test image on the recording medium P in accordance with test image data; a reading step of reading the test image and a front end on a downstream side in a direction of the rotary movement of the recording medium P when the test image is recorded; and a recording operation start position setting step of setting the recording operation start position based on a recording position of the test image on the recording medium P, the recording position being specified from data read in the reading step. The test image recording step, the reading step and the recording operation start position setting step are performed before the recording step. This allows the recording operation start position to be set readily and accurately based on the test image recorded by the inkjet recording device 1.

The above embodiment and its variation should not be construed to limit the present invention, and various modifications may be made.

For example, the conveyance drum 21 has three predetermined placement positions on the conveyance member 211 to place the recording medium P in the above embodiment. The conveyance drum 21 may have any number of placement positions other than three, for example, one, two, four, or more.

In the above embodiment, the recording operation start positions for the recording operation on the front face and the back face of the recording medium P are set separately. Alternatively, a single recording operation start position may be set for each placement position in the case where contraction or expansion of the recording medium P is negligible or where image recording is performed only on one face of the recording medium P. In this case, Steps S15 to S18 are omitted from the process of setting the recording operation start position in FIG. 4.

The process of setting the recording operation start position may be performed for each type of recording medium to determine the recording operation start position for each type of recording medium.

Two or more recording operation start positions for the recording operation on the back face of the recording medium P may be set for a single placement position. Depending on the amount of ink discharged during image recording on the front face of the recording medium P, one recording operation start position may be selected from these recording operation start positions for the recording operation on the back face of the recording medium P to perform image recording on the back face. This enables accurate image recording on the back face of the recording medium P at a desired position in the case of variable contraction or expansion rate of the recording medium P, depending on the amount of ink discharged on the front face of the recording medium P.

In the above embodiment, the position corresponding information indicating the position of the conveyance member 211 is the count of the number of pulsed signals from the rotary encoder 52. Alternatively, other position corresponding information indicating the movement amount from the predetermined reference position of the conveyance member may be used to determine the timing of starting the recording operation.

In the above embodiment, the image reader 26 detects the front end on the downstream side in the conveyance direction of the recording medium P and reads the test image in the process of setting the recording operation start position. Alternatively, a detector other than the image reader 26 may detect the front end of the recording medium P. In this case, the image reader 26 starts reading when the recording medium P is conveyed by a distance from a detecting point to a reading point of the image reader 26 after the detection of the front end by the detector. This allows a distance between the front end of the recording medium P and the test image to be acquired from the results of the reading by the image reader 26. The detector may be a unit optically or tactually detecting the front end.

In the above embodiment, the image reader 26 of the inkjet recording device 1 detects the front end of the recording medium P and reads the test image to determine a recording operation start position. Alternatively, an image reader provided outside the inkjet recording device 1 may detect the front end of the recording medium P and read the test image to determine a recording operation start position based on the results of reading.

In the above embodiment, the claws 212 of the conveyance drum 21 press the front end in the conveyance direction of the recording medium P. Alternatively, the claws 212 may press the rear end in the conveyance direction of the recording medium P. Alternatively, the claws 212 may press both the front end and the rear end.

In the above embodiment, the claws 212 include both the position determiners 212*a* and the holders 212*b*. The position determiners 212*a* come into contact with at least one of the front end and the rear end of the recording medium P. The holders 212*b* hold the recording medium P on the conveyance member 211. Alternatively, the position determiners and the holders may be separate units.

In the above embodiment, the conveyance drum 21 conveys the recording medium P. Alternatively, a conveyance belt that moves in accordance with the rotation of two rollers that support the conveyance belt may be used to convey the recording medium P in the inkjet recording device according to the present invention.

In the above embodiment, the inkjet recording device 1 is equipped with a line head having nozzles arrayed to cover an image forming area in the X direction of the recording medium P. Alternatively, the inkjet recording device according to the present invention may perform image recording while an image is scanned with a recording head.

Though several embodiments of the present invention have been described, the scope of the present invention is not limited to the above-mentioned embodiments, and includes the scope of inventions, which is described in the scope of claims, and the scope equivalent thereof.

INDUSTRIAL APPLICABILITY

The present invention is applicable to inkjet recording devices and inkjet recording methods.

EXPLANATION OF REFERENCE NUMERALS

1 inkjet recording device
2 external device
10 sheet feeder
11 sheet feeding tray
12 medium feeder
20 image recorder
21 conveyance drum
211 conveyance member
211 a conveyance surface
212 claws
212 a position determiners
212 b holder
213 air sucking portion
22 passing unit
23 heater
24 head unit
241 recording head driver
242 recording head
25 fixer
26 image reader
27 delivery section
28 inverter
30 sheet ejector
31 sheet ejecting tray
40 controller
41 CPU
42 RAM
42 a recording operation start position data
43 ROM
44 memory
51 conveyance driver
52 rotary encoder
53 input/output interface
54 bus

The invention claimed is:

1. An inkjet recording device, comprising:

a recorder which discharges ink onto a recording medium;

a conveyer which performs a conveyance operation of placing the recording medium at a predetermined placement position on a conveyance member and performing a rotary movement of the conveyance member; and a hardware processor that:

causes the recorder to perform a recording operation of recording an image by discharging ink onto the recording medium in accordance with image data, the recording medium being moved by the conveyance operation; and acquires position corresponding information corresponding to a position of the conveyance member, the position being determined by the conveyance operation, wherein the hardware processor causes the recorder to start the recording operation when the position of the conveyance member corresponding to the acquired position corresponding information matches a recording operation start position which is set in advance.

2. The inkjet recording device according to claim 1, wherein a plurality of placement positions is set on the conveyance member.

3. The inkjet recording device according to claim 2, further comprising a second inverter which inverts the recording medium placed on the conveyance member and places the inverted recording medium at any one of the placement positions, wherein the recording operation start position is set in advance for each of a case where a target face of the recording medium on which the recording operation is performed at each of the placement positions is one face of the recording medium and a case where the target face of the recording medium is the other face which is opposite to the one face, the hardware processor causes the recorder to perform the recording operation on the one face of the recording medium, thereafter causes the second inverter to invert the recording medium, and causes the recorder to perform the recording operation on the other face of the recording medium, and the recording operation by the recorder on each of the one face and the other face of the recording medium is started when the position of the conveyance member matches the recording operation start position corresponding to a placement position at which the recording medium is placed and the target face of the recording medium on which the recording operation is performed, the position of the conveyance member corresponding to the acquired position corresponding information.

4. The inkjet recording device according to claim 1, further comprising a first inverter which inverts the recording medium placed on the conveyance member and places the inverted recording medium at the placement position, wherein the recording operation start position is set in advance for each of a case where a target face of the recording medium on which the recording operation is performed by the recorder is one face of the recording medium and a case where the target face of the recording medium is the other face which is opposite to the one face, the hardware processor causes the recorder to perform the recording operation on the one face of the recording medium, thereafter causes the first inverter to invert the recording medium, and causes the recorder to perform the recording operation on the other face of the recording medium, and the recording operation by the recorder on each of the one face and the other face of the recording medium is started when the position of the conveyance member matches the recording operation start position corresponding to the target face of the recording medium on which the recording operation is performed, the position of the conveyance member corresponding to the acquired position corresponding information.

5. The inkjet recording device according to claim 1, wherein the hardware processor acquires the position corresponding information indicating a movement amount from a predetermined reference position of the conveyance member in the conveyance operation.

6. The inkjet recording device according to claim 5, further comprising a movement detector which outputs a predetermined detection signal for each predetermined amount of movement of the conveyance member, and the hardware processor acquires the position corresponding information from the output detection signal.

7. The inkjet recording device according to claim 1, further comprising a rotary encoder.

8. The inkjet recording device according to claim 1, wherein the conveyer includes: a position determiner which fixes a position of the recording medium at the placement position by contacting at least one of a front end and a rear end in a direction of the rotary movement of the recording medium; and a holder which holds an end of the recording medium on the conveyer, at least one of the front end and the rear end of the recording medium being pressed by the position determiner.

9. The inkjet recording device according to claim 1, wherein the conveyer includes a cylindrical drum, the recording medium is placed on an outer periphery of the drum, and the conveyer performs the conveyance operation by rotating the drum about a cylindrical shaft.

10. The inkjet recording device according to claim 1, further comprising a storage which stores recording operation start position information indicating the recording operation start position.

11. The inkjet recording device according to claim 10, wherein the hardware processor causes the recorder to perform the recording operation to record a predetermined test image on the recording medium in accordance with predetermined test image data, the inkjet recording device further comprises:

a first reader which reads a front end on a downstream side in a direction of the rotary movement of the recording medium on which the test image is recorded and which is conveyed by the conveyer; and a second reader which reads the test image recorded on the recording medium, and the hardware processor sets the recording operation start position based on a recording position of the test image on the recording medium and stores the recording operation start position information in the storage, the recording position of the test image being specified from data read by the first reader and the second reader.

12. The inkjet recording device according to claim 11, wherein the test image includes a line pattern including a line orthogonal to the direction of the rotary movement.

13. The inkjet recording device according to claim 11, wherein the hardware processor causes the conveyer to perform the conveyance operation such that a movement speed of the conveyance member during reading by at least one of the first reader and the second reader is smaller than a movement speed of the conveyance member during the recording operation by the recorder.

14. An inkjet recording method by an inkjet recording device that includes: a recorder which discharges ink onto a recording medium; a conveyer which performs a conveyance operation of placing the recording medium at a predetermined placement position on a conveyance member and performing a rotary movement of the conveyance member; and a hardware processor which acquires position corresponding information corresponding to a position of the conveyance member, the position being determined by the conveyance operation, and the method comprising:

a recording step of causing the recorder to perform a recording operation of recording an image by discharging ink onto the recording medium in accordance with image data, the recording medium being moved by the conveyance operation, wherein in the recording step, the recorder is caused to start the recording operation when the position of the conveyance member corresponding to the acquired position corresponding information matches a recording operation start position which is set in advance.

15. The inkjet recording method according to claim 14, further comprising:

a test image recording step of causing the recorder to perform the recording operation to record a predetermined test image on the recording medium in accordance with predetermined test image data;

a reading step of reading the test image and a front end on a downstream side in a direction of the rotary movement of the recording medium when the test image is recorded; and a recording operation start position setting step of setting the recording operation start position based on a recording position of the test image on the recording medium, the recording position being specified from data read in the reading step, wherein the test image recording step, the reading step and the recording operation start position setting step are performed before the recording step.

* * * * *